United States Patent [19]

Hagiwara

[11] Patent Number: 5,056,174

[45] Date of Patent: Oct. 15, 1991

[54] DRY CLEANING METHOD AND APPARATUS

[75] Inventor: Haruo Hagiwara, Aichi, Japan

[73] Assignee: Mitsubishi Jukogyo K.K., Tokyo, Japan

[21] Appl. No.: 472,570

[22] Filed: Jan. 30, 1990

Related U.S. Application Data

[62] Division of Ser. No. 384,843, Jul. 24, 1989, Pat. No. 4,912,793.

[30] Foreign Application Priority Data

Jul. 17, 1986 [JP] Japan ..... 61-168837

[51] Int. Cl.[5] ..... D06F 43/08

[52] U.S. Cl. ..... 8/158; 8/159; 68/18 R; 68/18 C

[58] Field of Search ..... 68/18 C, 18 F, 18 R; 210/107; 202/170, 186, 202; 203/87; 134/12, 109, 111; 8/158, 159

[56] References Cited

U.S. PATENT DOCUMENTS

| | | | |
|---|---|---|---|
| 2,438,252 | 3/1948 | Richardson . | |
| 2,759,346 | 8/1956 | Beduhn | 68/18 F |
| 2,979,375 | 4/1961 | Kircher, Jr. et al. | 68/18 R X |
| 3,692,467 | 9/1972 | Durr et al. | 68/18 C X |
| 3,712,087 | 1/1973 | Zucchini | 68/27 X |
| 3,923,541 | 12/1975 | Healy | 134/108 X |
| 3,951,682 | 4/1976 | Schevey et al. | 134/108 X |
| 4,444,625 | 4/1984 | Smith . | |
| 4,556,456 | 12/1985 | Ruckriegel et al. | 202/186 |
| 4,712,392 | 12/1987 | Hagiwara et al. | 68/18 C |

FOREIGN PATENT DOCUMENTS 2812666 10/1978 Fed. Rep. of Germany .

*Primary Examiner*—Frankie L. Stinson

*Attorney, Agent, or Firm*—Stanger, Michaelson, Spivak & Wallace

[57] ABSTRACT

There are disclosed a dry cleaning method and apparatus using organic solvents in which two types of solvents melted to each other, one of which is a solvent (for example, perchloroethylene or 1.1.1 trichloroethane) having large washing power and the other of which is a solvent (for example, fleon R113 or terpene) having high safety for clothes can be simultaneously possessed and mixed to a predetermined mixture ratio in the range in which the respective characteristics of both the solvents do not interfere with each other by a fractionating device of the solvents, whereby almost all materials for clothes can be cleaned.

With the structure, a single dry cleaner can clean almost all material for clothes and can increase the generality greatly as compared with the prior art cleaner.

3 Claims, 3 Drawing Sheets

FIG. 2A
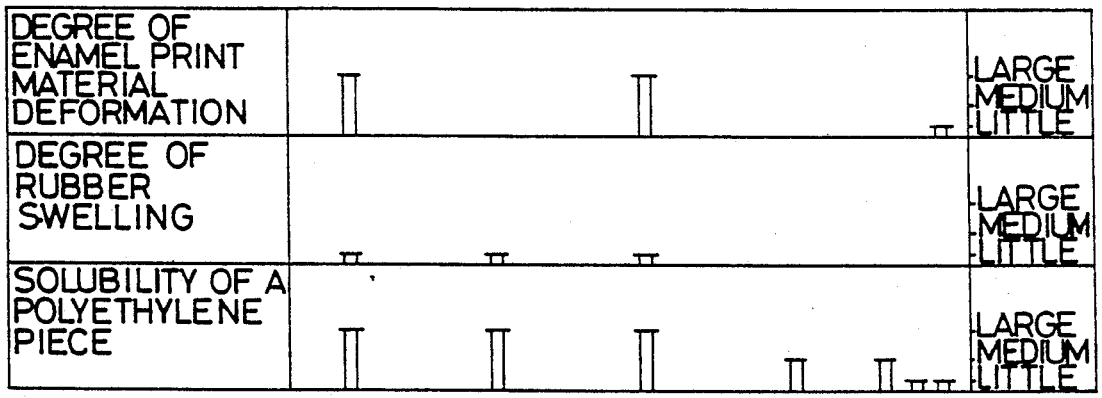
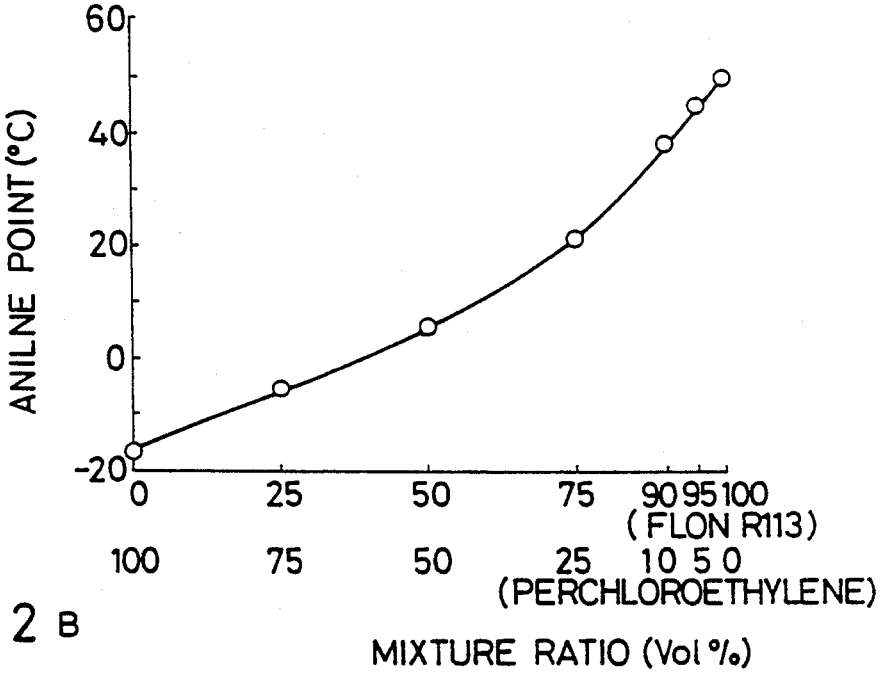
FIG. 2B

DRY CLEANING METHOD AND APPARATUS

This is a division of Ser. No. 384,843 filed July 24, 1989, now U.S. Pat. No. 4,912,793.

FIELD OF THE INVENTION AND RELATED ART STATEMENT

Referring to FIG. 4 showing a system diagram of a conventional dry cleaner, the dry cleaning processes using the organic solvent except the terpene are now described. Clothes 2 are first put in the cleaner through a door 1 and the door 1 is then closed. When operation of the cleaner is started, the cleaner is generally operated in the following sequence.

(1) A solvent 4 is pumped up from a solvent tank 3 through a valve 5 by a pump 6 so that a necessary amount of solvent 4 is fed into a processing tank 10 through a valve 7 and a filter 8 or through a valve 9.

(2) A processing drum 11 is slowly rotated and at the same time the solvent 4 is circulated through a circuit consisting of the processing tank 10, a button trap 12, a valve 13, the pump 6, the valve 7 and the filter 8 or the valve 9 so that the clothes 2 are washed.

(3) The solvent 4 is exhausted through the processing tank 10, the button trap 12, the valve 13, the pump 6, the valve 14 and a distiller 15, and the processing drum 11 is then rotated at a high speed to centrifugalize the solvent 4 contained in the clothes 2 and exhaust it.

(4) The processes (1) and (2) are repeated.

(5) The solvent 4 is exhausted through the processing tank 10, the button trap 12, the valve 13 and the valve 5 into the solvent tank 3 and the processing drum 11 is then rotated at a high speed to centrifugalize the solvent 4 contained in the clothes 2 and exhaust it.

(6) The processing drum 11 is slowly rotated again and air is circulated through a recovery air duct 19 consisting of a fan 16, an air cooler 17 and an air heater 18 and the processing tank 10 in the direction of arrow 20 to dry the clothes 2. Solvent gas evaporated from the clothes 2 is condensed in the air cooler 17 and is fed in a water separator 22 through a withdrawal path 21 to be further fed in a clean tank 24 through a solvent pipe 23.

(7) When the drying of the clothes 2 is finished, dampers 25 and 26 are opened as shown by broken line to introduce fresh air from the damper 25. Thus, solvent gas which has not been condensed and withdrawn in the air cooler 17 is exhausted from the damper 26 and smell of the solvent contained in the clothes 2 is removed.

(8) The solvent 4 entered into the distiller 15 in the process (3) is evaporated and is then condensed in a condenser 27. Further, the condensed solvent is sent out from the condenser 27 through the water separator 22 and the solvent pipe 23 into the clean tank 24 and is then returned to the solvent tank 3 through an overflow partition plate 28. Water separated by the water separator 22 is exhausted outside of the cleaner through a water pipe 29.

FIGS. 5 and 6 show the dry cleaning processes using terpene (petroleum solvent). The dry cleaning apparatus using terpene is generally divided into a washing and solvent-extracting tank 100, shown in FIG. 5, similar to the processing tank of FIG. 4 and a drying tank 200 (named a tumbler) shown in FIG. 6. In the washing and solvent-extracting tank 100, the washing process using other solvent described above and the same processes as the above-described processes (1), (2) and (5) are performed to complete all processes. In the dry cleaning using terpene, generally the evaporation of the solvent is not made and instead the fatty acid adsorbent such as porous aluminum and the decolorizing agent such as active carbon are filled into a filter **8*b* to purify the solvent 4**.

The clothes 2 from which the solvent has been extracted are taken out from the door 1 and put into a processing tank **10*a* of the tumbler of FIG. 6 from a door 1*a* thereof. The tumbler introduces outside air 20*a* therein from an inlet duct 19*b* by a fan 16. The air is heated by an air heater 18 and is sent in the processing tank 10*a*. The solvent 4 contained in the clothes 2 is evaporated and exhausted outside of the tumbler from an outlet duct 19*a***, thereby drying of the clothes is finished.

As described above, the general dry cleaning processes using various solvents have been described and the dry cleaner using these solvents adopts the washing and drying system using a single solvent even if any solvent is used.

Table 1 shows comparison of representative physical properties of solvents which are mainly used at the present time. Table 2 shows comparison of features, limitations, defects and the like in dry cleaning caused by the representative physical properties of the solvents shown in Table 1.

TABLE 1

| | Boiling Point (°C.) | Specific Gravity (g/cc) | KB Value | Burning Point (°C.) |
|---|---|---|---|---|
| 1.1.1 trichloroethane | 74 | 1.35 | 124 | not burn |
| perchloroethylene | 121 | 1.62 | 90 | not burn |
| FLON 113 | 47.5 | 1.58 | 31 | not burn |
| terpene (petroleum group) | 150–200 | 0.8 | 31 | 38 |

In Table 1, the KB value is one of a measure representative of relative solubility of the solvent and the larger the numerical value thereof is, the larger the solubility is.

TABLE 2

| | Features | Limitations Defects | Others |
|---|---|---|---|
| 1.1.1 trichloroethane | Large solubility and washing power. Hardly contaminated. Relatively low boiling point. Suitable for men's suit and wool knit. Low temperature drying. | Unsuitable for urethane processed goods, adhesive material, recent delicate clothes, pigment, print, particular resin, rubber. Main part of apparatus formed of stainless. | Somewhat difficult to withdraw activated charcoal (stability of withdrawn solvent has problem). Market is sharply grown last some years. |
| perchloroethylene | Solubility and washing power are large next to 1.1.1 trichloroethane. High boiling point next to terpene. Suitable for men's suit and wool knit. | Substantially same as above. Slightly high drying temp. Material weak for heat needs caution. | Synthetic solvent is most spread. Main part of apparatus can be formed of plated iron. |
| FLON 113 | Small solubility and washing power. | Difficult to remove dirt due to low washing | Solvent is most expensive. |

TABLE 2-continued

| | Features | Limitations Defects | Others |
|---|---|---|---|
| | Low boiling point. Capable of dealing with most of material for clothes (suitable for delicate clothes). Low temperature and short time drying. | power. Solvent withdrawal technique of freeing type or using activated charcoal is required. Main part of apparatus is formed of stainless. | Market is slowly grown. |
| terpene (petroleum) | Solubility and washing power are small. Capable of dealing with most of material for clothes. | Highest boiling point and inflammability. Difficult to remove dirt. Difficult to control solvent. Long washing and drying time. | Cheapest solvent but large loss. Delicate clothes must be dried with wind. Main part of apparatus can be formed of plated iron. |

As described above, in the conventional dry cleaner using exclusively only a single solvent, since the cleaner has both merits and demerits depending on characteristics of the solvent as described in Tables 1 and 2, it is necessary to properly use the solvent in accordance with various materials for clothes, processing and forms.

More particularly, high washing efficiency is required for clothes having deep dirt and accordingly perchloroethylene or 1.1.1 trichloroethane having high solubility and washing power is suitable. On the other hand, clothes (so-called delicate clothes) which tend to be affected by solution and swelling due to the solvent require stability. Accordingly, FLON 113 or terpene (petroleum group) which can deal with most of materials for clothes is required.

However, possession of both the dry cleaners is difficult in view of space and amount of investment in the plant. Actually, one dry cleaner is employed at the sacrifice of one of the washing efficiency or the stability or an order for washing clothes is given to a special outside factory.

OBJECT AND SUMMARY OF THE INVENTION

The present invention has been made to solve the above problems, and an object of the present invention is to provide a dry cleaning method and an apparatus thereof in which two solvents one of which has large washing power and the other of which has high safety for clothes are simultaneously possessed and mixed to maintain a predetermined mixture ratio of the two solvents so that the respective characteristics of both the solvents do not interfere with each other and all various clothes can be treated.

The structure for achieving the object is as follows.

(1) The dry cleaning method using organic solvents is characterized in that two types of solvents melted to each other, one of which is a solvent (for example, perchloroethylene or 1.1.1 trichloroethane) having large washing power and the other of which is a solvent (for example, fleon R113 or terpene) having high safety for clothes can be simultaneously possessed and mixed to a predetermined mixture ratio in the range in which the respective characteristics of both the solvents do not interfere with each other by means for fractionating the solvents, whereby almost all materials for clothes can be cleaned.

(2) The dry cleaning apparatus employing organic solvents is characterized by the provision of a processing tank, a solvent tank containing at least two or more types of solvents both of which are melted to each other and mixed to a predetermined mixture ratio, filters for the respective solvents disposed between the solvent tank and the processing tank, a fractionating device including a distiller, a condenser and a water separator for fractionating and withdrawing the at least two or more types of solvents, and a recovery duct including a cooler and a heater having both ends connected to the processing tank and which is connected to a refrigerator.

In brief, according to the present invention, in order to solve the above problems, two types of solvents melted to each other and having characteristics different from each other, one of which is a solvent, for example perchloroethylene, having large washing power and the other of which is a solvent, for example fleon R113, having high safety, can be simultaneously possessed in one dry cleaner, and the processing tank, a pump and a solvent circulation path are commonly employed to make inexpensive the machine. Thus, there is further provided a fractionating device for fractionating the solvents so that the mixture of solvents formed during washing becomes to a predetermined mixture ratio in the range in which the respective characteristics of the solvents do not interfere with each other.

With the above structure, almost all materials for clothes can be cleaned by a single dry cleaner and generality of the cleaner is increased greatly as compared with the prior art.

According to the present invention, it is not necessary to employ two or more conventional dry cleaners using solvents having characteristics different from each other with respect to at least the washing power and the safety in accordance with various materials, processing and forms of clothes and a single dry cleaner can treat almost all materials of clothes.

Accordingly, large burden to the user, such as increase of the space and the investment amount for installation, can be reduced.

BRIEF DESCRIPTION OF THE DRAWINGS

FIGS. 2A and 2B are characteristic diagrams showing the mixture ratio of perchloroethylene and fleon R113 and influence thereof to material of clothes;

DETAILED DESCRIPTION OF A PREFERRED EMBODIMENT

FIG. 2 shows a relation between the aniline point and the mixture ratio of perchloroethylene and FLON 113, and bad effects on to materials of clothes.

As apparent from FIGS. 2A and 2B, if about 5 vol % of perchloroethylene is mixed in pure FLON 113, the safety to clothes is similar. Reversely, if about 50 vol % of FLON 113 is mixed in pure perchloroethylene, cleaning can be made without reduction of the solubility and washing power. The same thing can be mentioned in view of variation of the aniline point and the characteristic of the aniline point has different tendencies depending on whether the mixture ratio is less than 50 vol % more than 50 vol %.

The aniline point of FIG. 2B is one of scales expressing the relative solubility of the solvent and shows that the solubility is larger as the temperature is lower. The aniline point is similar to KB value of Table 1.

Figure 3:
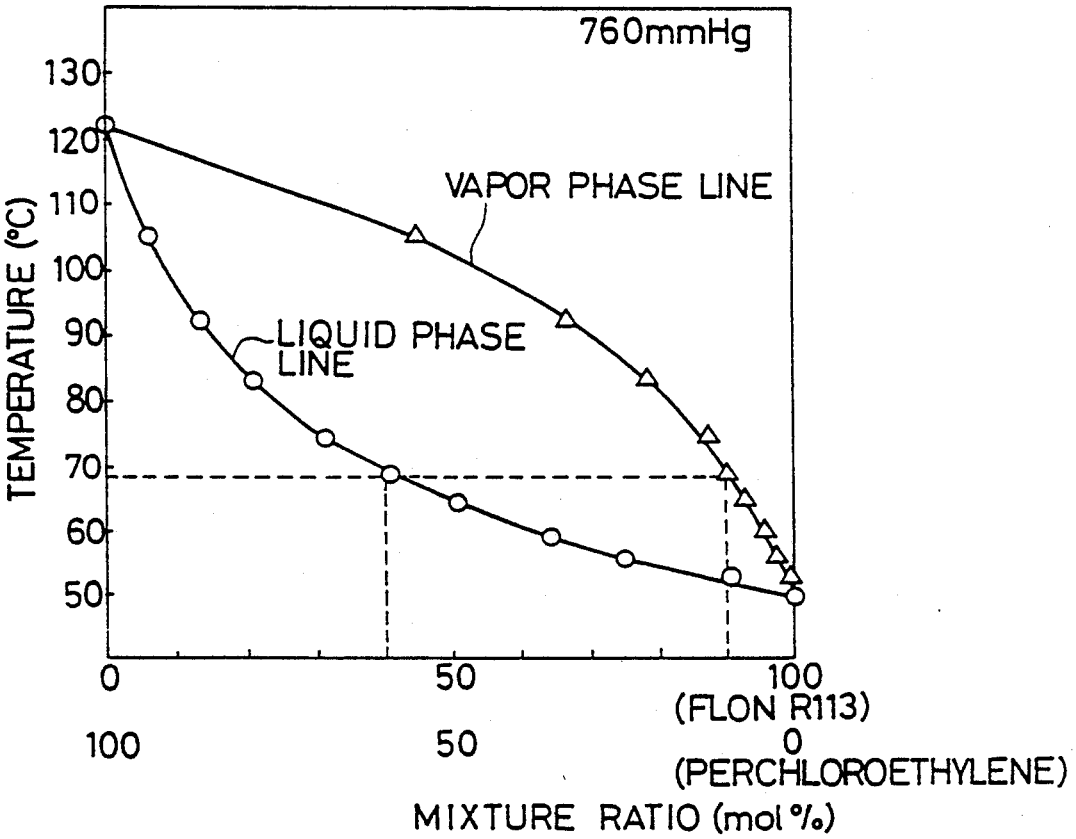
FIG. 3 is a characteristic diagram showing a balance of vapor and liquid upon distillation with respect to the same mixture ratio of that of FIGS. 2A and 2B.

FIG. 3 is a balance diagram of vapor and liquid in the case of perchloroethylene and FLON 113.

For example, when the mixed liquid of FLON 113 containing perchloroethylene of 40 mol % is heated and distilled, the liquid begins to boil at about 68° C. It is shown that the solvent containing much FLON 113 having low boiling point (in this case, perchloroethylene of 10 mol % is contained) can be withdrawn when evaporated solvent gas is taken out and condensed.

Accordingly, detection of the boiling point in distillation and change-over of a valve provided in a path for distillation and withdrawal can discriminate the solvents having a predetermined mixture ratio in the range in which the respective characteristics of both the solvents do not interfere with each other and the discriminated solvents can be employed again as a next washing liquid.

Figure 1:
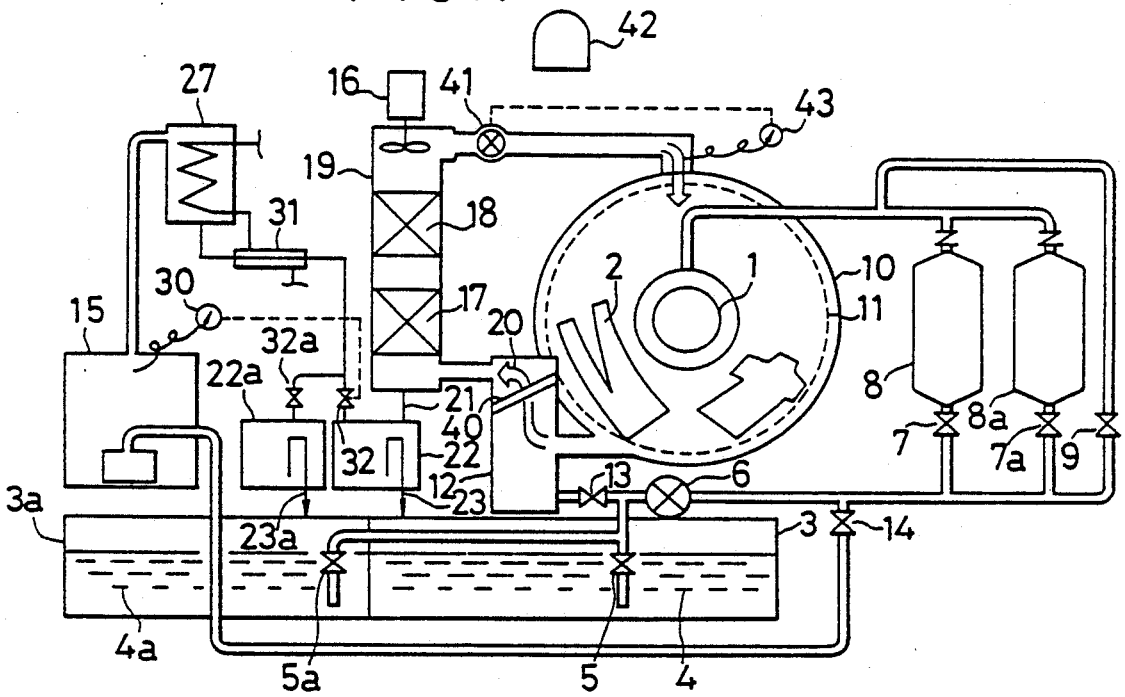
FIG. 1 schematically illustrates a dry cleaner according to an embodiment of the present invention.
Figure 4:
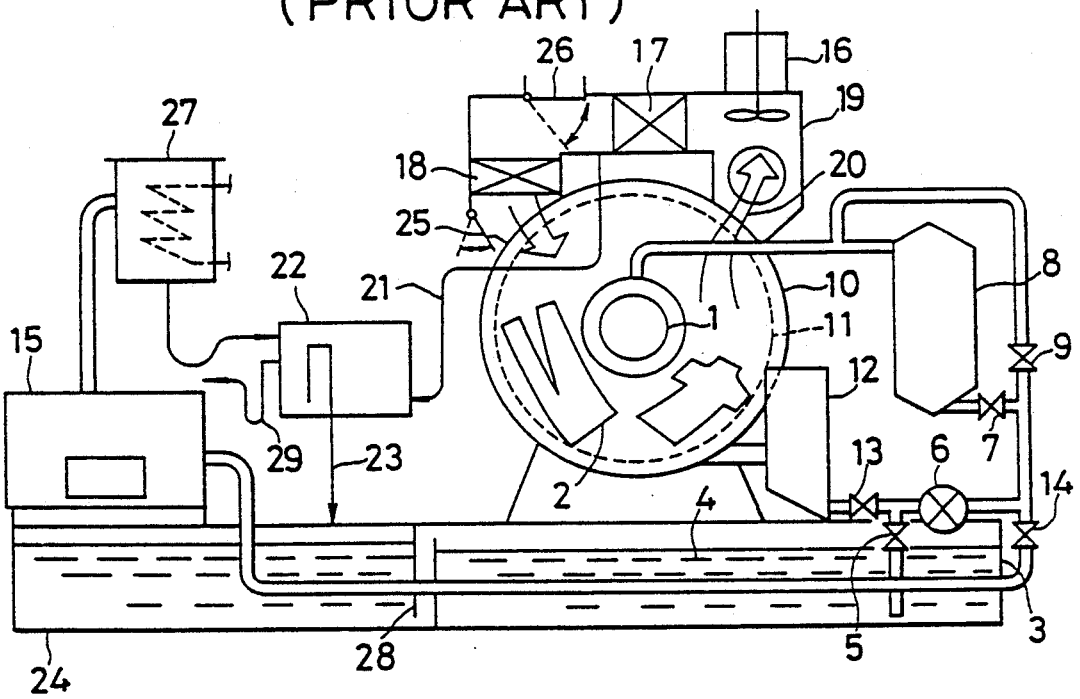
FIG.4 (PRIOR ART)
FIG. 4 is a configuration diagram of a conventional dry cleaner.
Figure 5:
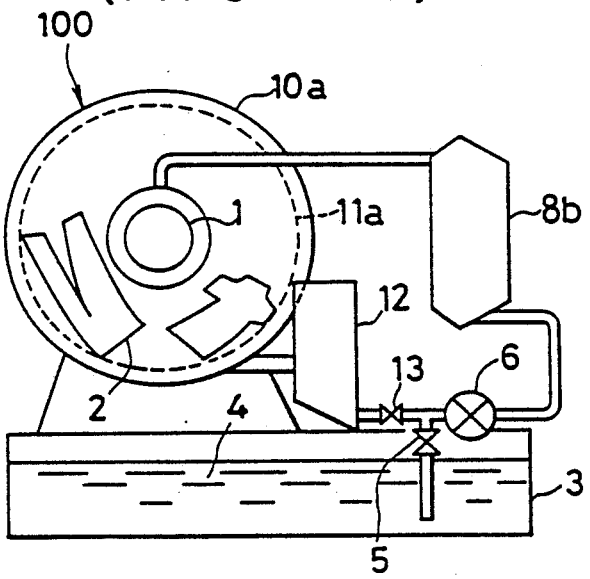
FIG.5 (PRIOR ART)
FIGS. 5 and 6 are configuration diagrams of conventional dry cleaners using terpene.
Figure 6:
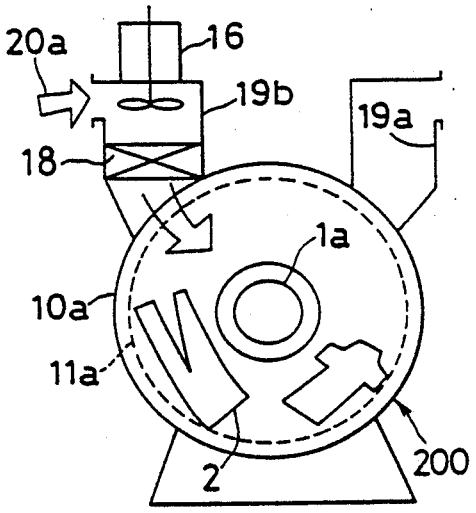
FIG.6 (PRIOR ART)

An embodiment of the present invention is now described with reference to FIG. 1. In FIG. 1, the same elements as those of the conventional apparatuses shown in FIG. 4 (dry cleaner using solvent except terpene) and FIGS. 5 and 6 are designated by the same reference numerals. Accordingly, description concerns mainly portions different from the prior art.

I. STRUCTURE (1) A solvent tank 3 containing a solvent 4 of flon 113 containing perchloroethylene of about 5 vol % and a solvent tank 3*a* containing a solvent 4*a* of perchloroethylene containing fleon R113 of 50 vol % are tanks independent of each other. There is no partitioning plate with overflow function as shown in FIG. 4 between both tanks 3 and 3*a*. The tanks 3 and 3*a* are provided with valves 5 and 5*a*, respectively.

The previously mixed solvent may be contained. Actually, if pure solvents are however contained in the tanks and the apparatus is operated, both the solvents are mixed in a predetermined mixture ratio by the following fractionating operation.

(2) A distiller 15 contains therein a sensor 30 which detects variation of the boiling point in distillation and is operated in interlocked relationship with a valve 32.

When any mixed liquid entered in the distiller 15 as an exhaust solvent is subjected to distillation, the solvent gas containing much flon 113 having low boiling point is first evaporated as shown in FIG. 3. The vapor is liquefied and cooled through a condenser 27 and a solvent cooler 31. During this operation, the boiling point is gradually increased. Thus, when the temperature for the sensor 30 is set to 70° C., the valve 32 is left open until the boiling point reaches the set value (at this time valve 32*a* is closed) and the solvent is returned to the solvent tank 3 through the water separator 22 and the solvent pipe 23 as flon 113 containing perchloroethylene of about 5 vol %.

Thereafter, the valve 32 is left closed until the distillation is completed (at this time, the valve 32*a* is opened) and the solvent is returned to the solvent tank 3*a* through the water separator 22*a* and the solvent pipe 23*a* as perchloroethylene containing flon 113.

In order to secure the desired mixture ratio, the withdrawal path formed of the condenser 27 and the solvent cooler 31 is required to remove any stay portion of the solvent and make the path as short as possible.

(3) A filter 8 for perchloroethylene and a filter 8*a* for flon 113 are independently provided. Valves 7 and 7*a* are provided for the filters 8 and 8*a*, respectively, to prevent the solvents from being mixed during circulation thereof.

(4) The recovery duct 19 is disposed at the side of the processing tank 10 and is provided therein with an air cooler 17 and a preheater 18 which are connected to a refrigerator 42.

During the drying, the processing drum 11 is slowly rotated and air is circulated by the fan 16 in the direction of arrow 20. The solvent gas evaporated from the clothes 2 is sent to the air cooler 17 through a lint filter 40 disposed in the button trap 12 so that the evaporated solvent gas is condensed and liquefied. Air is then reheated by the preheated 18 using the exhausted heat of the refrigerator 42 and is further heated by an auxiliary heater 41 to a predetermined temperature indicated by a thermostat 43 to dry clothes 2.

When the drying is finished, the heating source is cut off to reduce the cooling temperature of the air cooler 17 and the density of solvent gas can be reduced to the utmost. Accordingly, it is not necessary to take in fresh air to remove smell as made in the conventional apparatus. Thus, the dampers 25 and 26 as shown in FIG. 4 are not provided.

II. OPERATION (1) When clothes 2 are dirty strongly, the perchloroethylene solvent 4*a* is pumped up through the valve 5*a* by the pump 6 and is fed to the processing tank 10 through the valve 7 and the filter 8 or through the valve 9 by a necessary amount.

(2) When clothes 2 are delicate, the solvent 4 of fleon R113 is pumped up through valve 5, 7*a* and the filter 8*a* or through the valve 5 and 9.

(3) When the pumping of the solvent is completed, the processing drum 11 is slowly rotated and the solvent 4 or 4*a* is circulated through the path of the processing tank 10, the button trap 12, the valve 13, the pump 6 and the valve 7 or 7*a* or 9 to wash the clothes 2.

(4) The solvent 4 or 4*a* is exhausted through the valve 14 in the distiller 15. The processing drum 11 is subsequently rotated at a high speed to centrifuge the solvent contained in clothes 2 and exhaust the solvent.

When the above processes (1) to (4) are repeated, the solvents 4 and 4*a* remaining in the pump 6 and the path or contained in clothes 2 in the case both solvents are used before and behind the process are mixed to each other to a certain extent. However, the respective characteristics of both the solvents can not interfere with each other by minimizing the mixed ratio of both solvents.

(5) Any mixed liquid exhausted in the distiller 15 is fractionated to a predetermined mixture ratio again by the method described in the above item (2) and the fractionated solvents are returned to the solvent tank 3 and 3*a*, respectively.

(6) When the washing process is finished, clothes 2 is dried by the method described in the above item (4) and all the cleaning processes are finished.

The foregoing has been made to combination of two types of solvents, although three types of solvents may be treated in the same manner.

I claim:

1. A dry cleaning apparatus using organic solvents characterized by the provision of a processing tank, solvent tanks containing at least two or more types of solvents both of which are melted to each other and mixed to a predetermined mixture ratio, filters for the respective solvents disposed between the solvent tanks and the processing tank, a fractionating device including a distiller, a condenser and a water separator for fractionating and withdrawing the at least two or more types of solvents, and a recovery duct including a cooler and a heater having both ends connected to the processing tank and which are connected to a refrigerator.

2. A dry cleaning apparatus comprising:

a first source for holding a plurality of mixed solvents;

a container for holding contents to be processed;

means for drawing a plurality of mixed solvents from said first source into said container;

processing means for processing the contents of said container with the plurality of mixed solvents from said first source;

a fractionating arrangement for receiving the plurality of mixed solvents and separating out the plurality of mixed solvents;

return means for returning the fractionated plurality of mixed solvents from said fractionating arrangement to said first source;

a second source for holding a cleaning fluid, having a cleaning characteristic and boiling point different from the plurality of mixed solvents;

drawing means for drawing the cleaning fluid from said second source into said container to permit processing of the contents of in the container with the cleaning fluid;

means for passing the cleaning fluid through said fractionating arrangement to separate out the cleaning fluid; and means for returning the cleaning fluid to the second source.

3. The apparatus as in claim 2, wherein the first source and the second source are each separate solvent tanks.

* * * * *